US005115646A

United States Patent [19]

Bishop

[11] Patent Number: 5,115,646

[45] Date of Patent: May 26, 1992

[54] NOVELTY BRACELET

[76] Inventor: Thomas J. Bishop, Ten Lamson Rd., Barrington, R.I. 02806

[21] Appl. No.: 682,438

[22] Filed: Apr. 8, 1991

[51] Int. Cl.[5] ..... A44C 5/00

[52] U.S. Cl. ..... 63/9; 63/1.1; 63/DIG. 3; 16/386

[58] Field of Search ..... 63/3, 6, 9, 15.7, DIG. 3, 63/7, 8, 10, 1.1; D11/3, 4; 16/227, 255, 385, 386, DIG. 13, DIG. 33

[56] References Cited

U.S. PATENT DOCUMENTS

| | | | |
|---|---|---|---|
| D. 131,585 | 3/1942 | Barbieri | D11/4 |
| 1,482,647 | 2/1924 | Gise | D11/2 |
| 2,057,913 | 10/1936 | Piacentini | 63/9 |
| 2,503,570 | 4/1950 | Vogel | 63/9 |
| 2,707,800 | 5/1955 | Popper | 63/9 |
| 3,405,431 | 10/1968 | Polon | 292/209 |
| 3,668,890 | 6/1972 | Broido | 63/3 |
| 3,909,888 | 10/1975 | Funston et al. | 292/204 |
| 4,936,699 | 6/1990 | Yoshida | D11/3 |

*Primary Examiner*—Renee S. Luebke
*Assistant Examiner*—Michael J. Milano
*Attorney, Agent, or Firm*—Salter Michaelson & Benson

[57] ABSTRACT

Novelty bracelet in the form of a main body having the shape of a rectangular base from which extends an animal head and having hinged lateral arms that are movable from a first arm-embracing position to a second play or display position.

3 Claims, 1 Drawing Sheet

NOVELTY BRACELET

BACKGROUND OF THE INVENTION

In the design and manufacture of jewelry, it is often convenient to use a form which can be easily displayed, particularly if the jewelry has a desirable artistic value or some other interesting appearance. In the case of children's bracelets, however, it is difficult to display or to play with the item without using a separate mount or base. At the same time, when the bracelet is removed from the arm, it would be desirable to be able to rest it on a flat surface in such a way that it becomes a playable toy and so that the beauty or interesting appearance of the design can be easily seen. Of course, the possibility of damage to the design elements on the bracelet would be reduced if the main part could be stored upright and out of contact with the storage surface.

The prior art contains teachings of toy products that include a wrist-encircling bracelet or band, so that the toy can be worn on a child's wrist. Such constructions are shown in the U.S. Pat. No. 2,805,326, to Schwarz, U.S. Pat. No. 3,561,153 to Harper, U.S. Pat. No. 4,571,199 to Muraki, U.S. Pat. No. 4,589,660 to Tsuzuki, and U.S. Pat. No. 4,936,699 to Yoshida. These patents, however, do not provide for the alternate use of the device as a bracelet on the arm or as a toy on a table or floor surface. Neither are the described structures particularly adapted to use in a display mode or for support of an artistic form in a way intended to reduce the possibility of damage. These and other difficulties experienced with the prior art devices have been obviated in a novel manner by the present invention.

It is, therefore, an outstanding object of the invention to provide a novelty bracelet that can also be used as a toy or displayed in an upright position.

Another object of this invention is the provision of a bracelet whose arms are easily moved from a clasping position to a standing or self-supporting position.

A further object of the present invention is the provision of a novelty bracelet whose artistic central form can be stored with a reduced possibility of damage.

A still further object of the invention is the provision of a novelty bracelet which can be used alternatively as an arm ornament or as a toy.

It is a further object of the invention to provide a novelty arm ornament having a provocative artistic design, such as a representation of an alien military concept.

Another object of the invention is the provision of a novelty bracelet which is simple and rugged in construction, which can be easily manufactured from readily-available materials, which has a minimum of separate parts, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention relates to a novelty bracelet which has a main body having a generally rectangular base and which has arms that are hingedly attached to opposite sides of the base. Detent means is associated with the hinge means of each arm to releasably retain it selectively in a first or stand-up position in which the arm extends from the base generally in the plane of the base and a second wrist encircling position in which the arm extends at a right angle to the plane of the base.

More specifically, each arm is of arcuate configuration in the shape of a 90-degree arc, one end of which is hingedly attached to the main body and the other end of which is provided with a cross bar. The cross bar acts as a support element when the arm is in the first position, while the two cross bars approach or contact each other when the arms are in the second position. The main body may have the appearance of a military armored container having an animal head protruding upwardly therefrom, and the cross bars may be in the form of tank track units.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
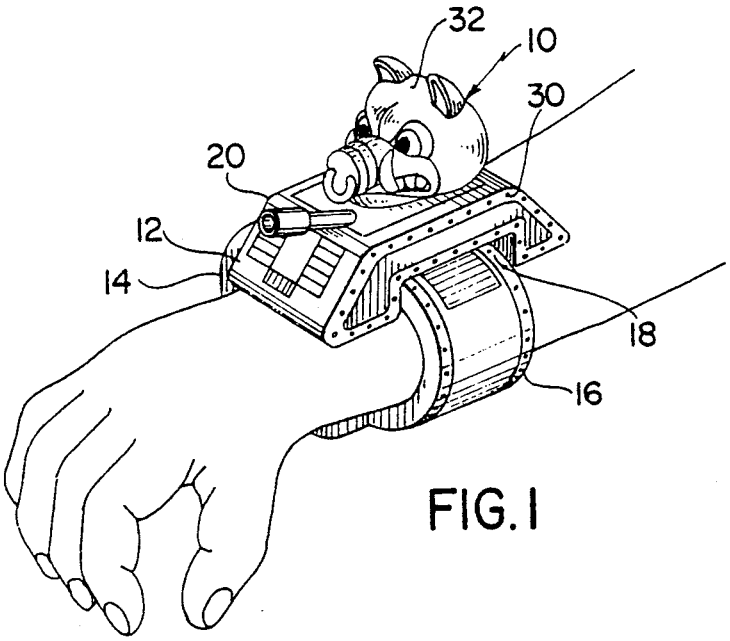
FIG. 1 is a perspective view of a novelty bracelet incorporating the principles of the present invention and showing it in use on a human arm.

Referring first to FIG. 1, which best shows the general features of the invention, the novelty bracelet, indicated generally by the reference numeral 10, is shown as having a main body 12 from the opposite sides of which extend arcuate arms 14 and 16. The arm 16 is connected to the main body by hinge means 18, while the arm 14 is similarly attached to the main body by hinge means 20. In this view of the invention, the arms are shown as located in a first, "bracelet" or wrist encircling position in which they embrace a human arm.

Figure 2:
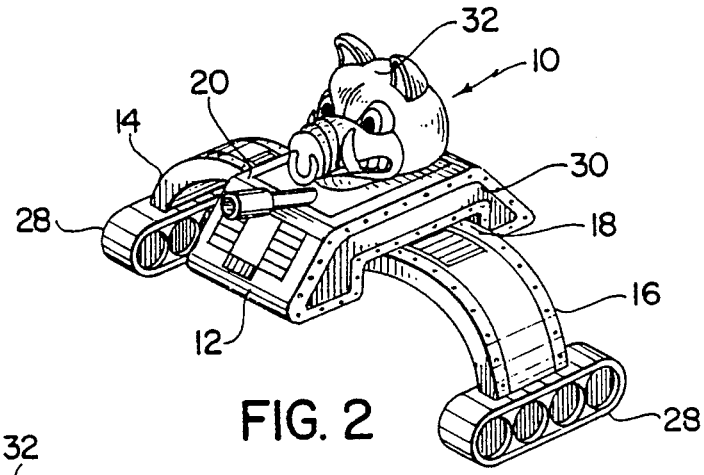
FIG. 2 is a perspective view of the bracelet, showing it in an alternative, play or display condition.

FIG. 2 shows the arms 14 and 16 in a second, "play" or stand-up position in which they extend directly laterally of the main body. Detent means 22 is provided in the hinge means 18 of the arm 16, and a similar detent means (not shown) is associated with the hinge means 20 of the arm 14.

Figure 3:
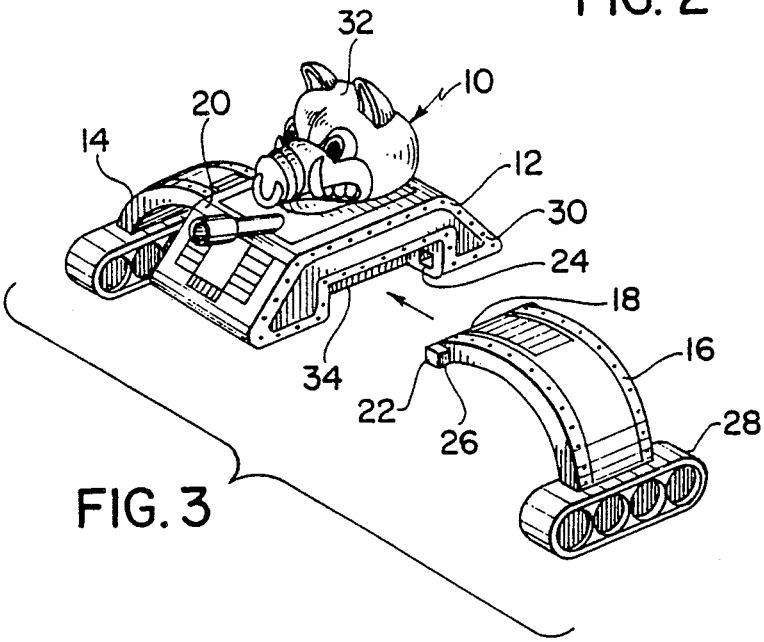
FIG. 3 shows an exploded perspective view of the invention, showing the details of the hinge construction.

As is evident in FIG. 3, the hinge means 18 comprise opposed sockets 24 formed in the main body and hinge pins 26 extending from the arm 16 The detent function is provided by the fact that the sockets 24 and their corresponding hinge pins 26 have square cross-sectional shapes and the fact that the sockets 24 are formed of a material that is substantially more elastic than that of the hinge pins.

The first and second positions of the arms, relative to the main body, are substantially 90 degrees apart, and they are releasably locked in those positions by the detent means 22. In the preferred embodiment of the invention, the main body 12 is formed by the rotation molding process, so that it is in the form of a hollow box-like element or base 30 from which extends an amusing head 32. The main body is formed of an elastomer, such as a low density polyvinyl chloride having a relatively low durometer. The arms 14, 16 are, on the other hand, formed by the injection molding process of a relatively rigid material, such as a high density vinyl having a higher durometer. This construction allows a recess 34 provided in the main body to be forced apart in order to enable the hinge pins 26 to snap snugly into the sockets 24. At the same time, the afore-described elasticity of the socket walls enables them to deform when the hinge pins are rotated, as occurs when the arms are rotated from one position to the other. Nevertheless, when the arms are in one position or the other, the elasticity of the sockets serves to releasably retain them in the selected position.

The operation and advantages of the present invention will now be easily understood in view of the above description. It can be seen from the drawings that the main body 12 is formed with a generally rectangular base or container 30 with recesses 34 formed on opposite sides to the receive the arms 14, 16. This base has the appearance of a military armored container or tank body with an animal head 32 protruding upwardly from it. The outer ends of the arms are provided with cross bars 28, which may have the appearance of the tractor unit of a tank. When the arms are in the first or wrist encircling position, shown in FIG. 1, the cross bars are close together or in contact, as determined by the size of the human arm on which the bracelet has been placed. When the invention is in the second position, shown in FIG. 2, the cross bars function as support means for mounting the device 10 on a supporting surface. In that position, the invention is available for use as a toy or simply as an interesting display.

In practice, of course, the main body 12 is manufactured separately from the arms, since they use different materials and use different manufacturing processes. The assembly, however, is relatively simple, since the arm can be snapped in place by forcing the recess 34 open until the hinge pins pass into their sockets. On occasion, it may be desirable to ship the parts in unassembled condition, in which case it is a simple matter for the ultimate user to make the assembly.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Novelty bracelet, comprising (a) a main body, (b) an arm extending from each of opposite sides of the body, (c) hinge means connecting the arms to the main body for pivotal swinging movement about spaced, parallel axes, (d) detent means associated with said hinge means to releasably lock the arms in either of two functional positions, (e) said hinge means consisting of opposed sockets in a recess in the main body, and hinge pins extending from the arms, said hinge pins being positioned in said sockets, and (f) each socket and its corresponding hinge pin having a square cross-sectional shape, the sockets being formed in a material that is substantially more elastic than that of the hinge pin.

2. Novelty bracelet as recited in claim 1, wherein the main body is in the form of a hollow box-like element with an amusing head portion extending upwardly therefrom.

3. Novelty bracelet, comprising (a) a main body having a generally rectangular base (b) arms attached by hinge means to opposite sides of the base, (c) detent means associated with the hinge means of each arm to lock it selectively in a first position in which the arm extends from the body generally in the plane of the base and a second wrist encircling position in which the arm extends generally at a right angle to the plane of the base, (d) each arm having a longitudinal cross section in the shape of a 90-degree arc, one end of which is hingedly attached to the body and the other end of which is provided with a cross bar, and (e) each of said cross bars extending substantially beyond the width of said arms, and having substantially flat bottom portions for securely mounting the bracelet on a support surface when the arms are in said first position, said cross bars being closely adjacent to each other when the arms are in said second position.

* * * * *